US011779954B1

(12) United States Patent
Novak

(10) Patent No.: US 11,779,954 B1
(45) Date of Patent: Oct. 10, 2023

(54) CAULKING ALIGNMENT DEVICE

(71) Applicant: Jacob Michael Novak, Afton, MN (US)

(72) Inventor: Jacob Michael Novak, Afton, MN (US)

( * ) Notice: Subject to any disclaimer, the term of this patent is extended or adjusted under 35 U.S.C. 154(b) by 0 days.

(21) Appl. No.: 17/199,670

(22) Filed: Mar. 12, 2021

(51) Int. Cl.
*B05C 17/06* (2006.01)
*E04F 21/165* (2006.01)

(52) U.S. Cl.
CPC ..... *B05C 17/06* (2013.01); *E04F 21/1655* (2013.01)

(58) Field of Classification Search
CPC ..... B05C 17/06; B05C 17/08; B05C 17/10; B05C 17/12; B05C 17/00; E04F 21/1655; E04F 21/1652; E04F 21/165; E04F 21/1657; E04F 21/652
USPC ..... 15/235.7, 236.7, 244.3, 261–266; 425/358, 468
See application file for complete search history.

(56) References Cited

U.S. PATENT DOCUMENTS

| | | | | |
|---|---|---|---|---|
| 6,880,198 | B1 * | 4/2005 | Hazard | E04F 21/1655 15/245.1 |
| 7,950,099 | B1 * | 5/2011 | Hanson | E04F 21/1652 7/105 |
| 8,845,223 | B2 * | 9/2014 | Liao | B05C 17/00516 401/265 |
| 2022/0048067 | A1 * | 2/2022 | Wold | E04F 21/1657 |

* cited by examiner

*Primary Examiner* — David J Walczak
(74) *Attorney, Agent, or Firm* — Johnson and Phung; Thomas N. Phung

(57) ABSTRACT

A caulking alignment device including a base substrate having at least two panels, an alignment tab located on each panel with each alignment tab having a front side and a back side with the front side of the alignment tab removably attached to the corresponding panel by a non-permanent adhesive with each of the tabs supported on the base substrate in a spaced and perpendicular condition from each other, a non-permanent adhesive located on each of the back sides, a removable film covering the adhesive on each of the back sides, and caulk receiving channels formed from a spacing between the alignment tabs.

19 Claims, 4 Drawing Sheets

CAULKING ALIGNMENT DEVICE

FIELD OF THE INVENTION

This invention relates generally to caulking tools and, more specifically to a caulking alignment device which works in conjunction with masking tape or painter's tape to assist users to perform a quick and visually appealing caulking job.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Simple caulking jobs, such those done in bathrooms and kitchen, may seem simple but typically are more complicated to accomplished in a quick and visually appealing manner due to the fact that caulk is generally messy and can easily be smeared and unevenly dispensed leading to gaps and chunks. The present invention attempts to solve the above problems by providing for a caulking alignment device which works in conjunction with masking tapes or painter's tape to assist users to perform a quick and visually appealing caulking job.

SUMMARY OF THE INVENTION

Briefly, the present invention comprises a caulking alignment device which works in conjunction with masking tapes or painter's tape to assist users to perform a quick and visually appealing caulking job. The caulking alignment device preferably includes a one-piece semi-rigid base substrate having a first panel, a second panel, and a third panel and a first non-permanent adhesive located on each of the panels of the base substrate.

Removably attached to the first panel by the first non-permanent adhesive is a first alignment tab having a masking tape engaging front side and a first room surface engaging back side. Removably attached to the second panel by the first non-permanent adhesive is a second alignment tab having a masking tape engaging front side and a second room surface engaging back side. The second alignment tab is supported on the base substrate in a spaced condition from the first alignment tab with the second room surface engaging back side located perpendicular to the first room surface engaging back side. Removably attached to the third panel by the first non-permanent adhesive is a third alignment tab having a masking tape engaging front side and a third room surface engaging back side. The third alignment tab is supported on the base substrate in a spaced condition from the first alignment tab and the second alignment tab with the third room surface engaging back side located perpendicular to the first room surface engaging back side and the second room surface engaging back side.

Located on each of the room surface engaging back sides of each of the alignment tabs is a second non-permanent adhesive and a removable film covering and protecting the second non-permanent adhesive on each of the room surface engaging back sides.

The caulking alignment device also includes a first caulk receiving channel formed from a spacing between the first alignment tab and the second alignment tab, a second caulk receiving channel formed from a spacing between the first alignment tab and the third alignment tab and a third caulk receiving channel formed from a spacing between the second alignment tab and the third alignment tab.

DESCRIPTION OF THE PREFERRED EMBODIMENT

Figure 1:
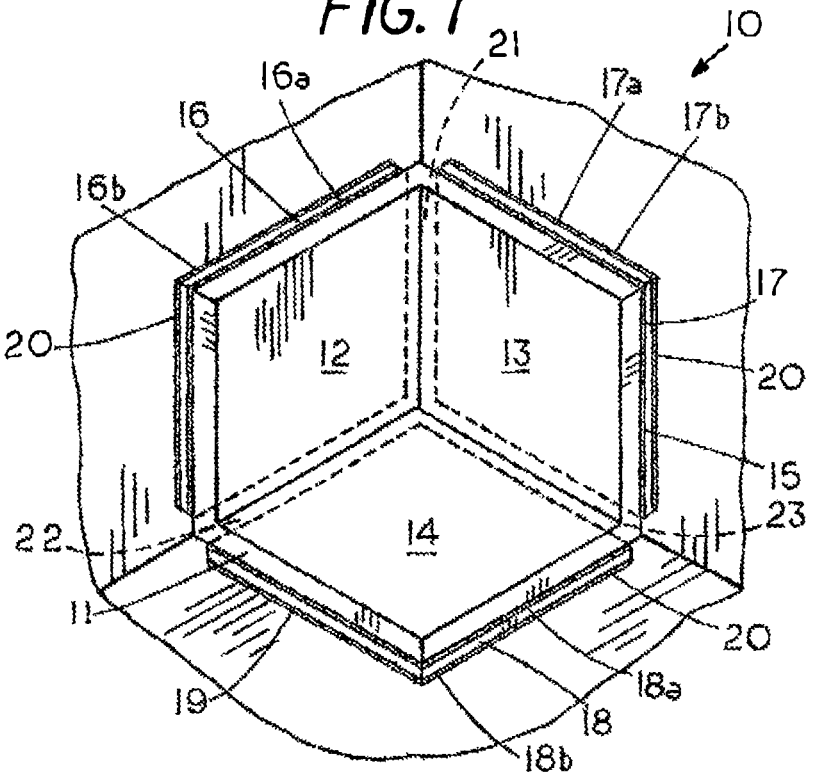
FIG. 1 is perspective view showing a caulking alignment device of the present invention positioned at a corner of a room.

The general purpose of the present invention, which will be described subsequently in greater detail, is to provide a caulking alignment device which works in conjunction with masking tape or painter's tape to assist users to perform a quick and visually appealing caulking job There has thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Figure 2:
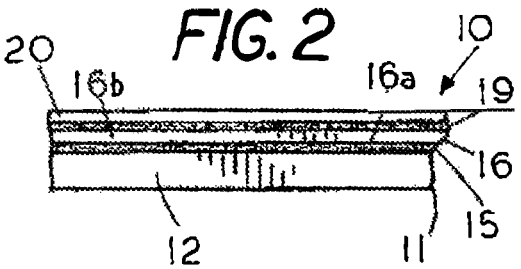
FIG. 2 is a partial top view showing a portion of caulking alignment device of FIG. 1.
Figure 3:
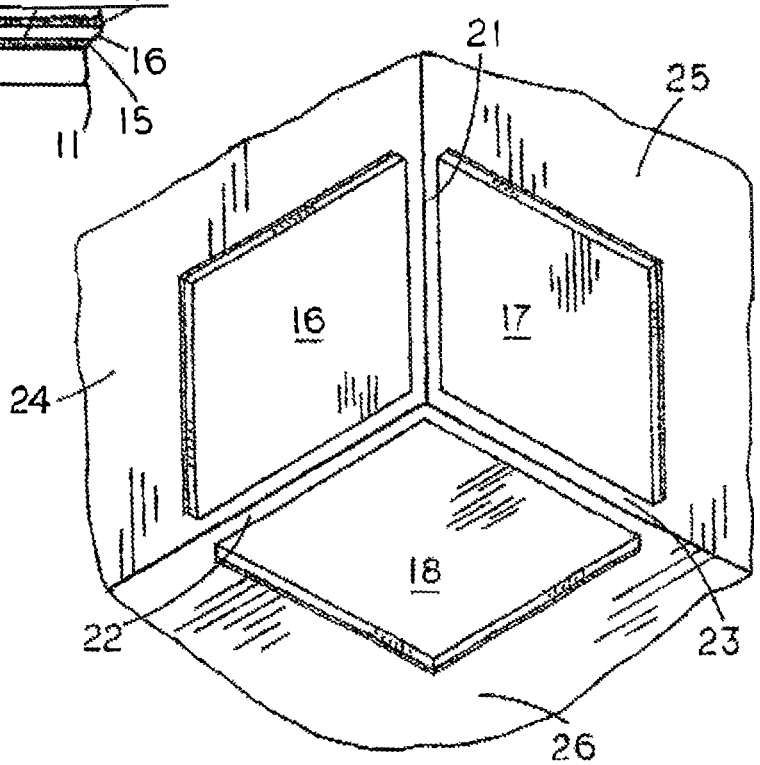
FIG. 3 is a perspective view showing the caulking alignment device of FIG. 1 removably secured to the adjacent surfaces of a room corner to be caulked.

Referring to FIGS. 1-3 of the drawings, FIG. 1 is perspective view showing an embodiment of a three-sided caulking alignment device 10 of the present invention positioned at a corner of a room. FIG. 2 is a partial top view showing a portion of caulking alignment device 10 of FIG. 1. FIG. 3 is a perspective view showing the caulking alignment device 10 of FIG. 1 removably secured to the adjacent surfaces of a room corner to be caulked.

In the embodiment FIG. 1, the caulking alignment device 10 generally includes a one-piece semi-rigid base substrate 11 having a first panel 12, a second panel 13, and a third panel 14. Although the embodiment of FIG. 1 shows base substrate 11 as being semi-rigid, alternative embodiments of the present invention may comprise a base substrate that may vary in rigidity such as but not limited to being bendable and flexible and malleable such as in the form of a thin film to a rigid metal member. The base substrate 11 may also comprise multiple pieces that are assemble to form a one-piece unit when ready for use. Located on each of the panels 12, 13, 14 of the base substrate 11 is a first non-permanent adhesive 15.

Removably attached to the first panel 12 of base substrate 11 is a first alignment tab 16 having a masking tape engaging front side 16*a* and a first room surface engaging back side 16*b* with the masking tape engaging front side 16*a* of the first alignment tab 16 attached to the first panel 12 by the first non-permanent adhesive 15.

Removably attached to the second panel 13 of base substrate 11 is a second alignment tab 17 having a masking tape engaging front side 17*a* and a second room surface engaging back side 17*b* with the masking tape engaging front side 17*a* of the second alignment tab 17 attached to the second panel 13 by the first non-permanent adhesive 15.

As shown in FIG. 1, the second alignment tab 17 is supported on the base substrate 11 in a spaced condition from the first alignment tab 16 with the second room surface engaging back side 17*b* and in turn the second alignment tab 17 located in a perpendicular condition to the first room surface engaging back side 16*b* and in turn the first alignment tab 16.

Removably attached to the third panel 14 of base substrate 11 is a third alignment tab 18 having a masking tape engaging front side 18*a* and a third room surface engaging back side 18*b* with the masking tape engaging front side 18*a* of the third alignment tab 18 attached to the third panel 14 by the first non-permanent adhesive 15.

The third alignment tab 18 is supported on the base substrate 11 in a spaced condition from the first alignment tab 16 and the second alignment tab 17 with the third room surface engaging back side 18*b* and in turn third alignment tab 18 located in a perpendicular condition to the first room surface engaging back side 16*b* and in turn the first alignment tab 16 and the second room surface engaging back side 17*b* and in turn the second alignment tab 17.

Located on each of the room surface engaging back sides 16*b*, 17*b*, 18*b* of each of the alignment tabs 16, 17, 18 is a second non-permanent adhesive 19 and a removable plastic or paper covering or film covering 20 which functions to protect the second non-permanent adhesive 19 on each of the room surface engaging back sides 16*b*, 17*b*, 18*b* from being dried out and/or exposed to contaminants that may reduce the functional properties of the second non-permanent adhesive 19.

Referring to FIGS. 1 and 3, the caulking alignment device 10 also includes a first caulk receiving channel 21, a second caulk receiving channel 22, and a third caulk receiving channel 23. The first caulk receiving channel 21 is shown formed from a spacing between the first alignment tab 16, the second alignment tab 17, and their engagement with a first room surface or first sidewall 24 and a second room surface or sidewall 25.

The second caulk receiving channel 22 is shown formed from a spacing between the first alignment tab 16, the third alignment tab 18 and their engagement with the first sidewall 24 and a third room surface or support surface 26. The third caulk receiving channel 23 is shown formed from a spacing between the second alignment tab 17, the third alignment tab 18 and their engagement with the second sidewall 25 and the support surface 26.

In further regards to the one-piece semi-rigid base substrate 11, the alignment tabs 16, 17, 18 and the removable film 20 each may either be made from different materials or from the same materials such as an environmentally friendly recyclable and compostable material. In addition, the one-piece semi-rigid base substrate 11 can also be made from a transparent material to allow users to confirm proper securement and alignment of the alignment tab to the surfaces of the room.

Figure 4:
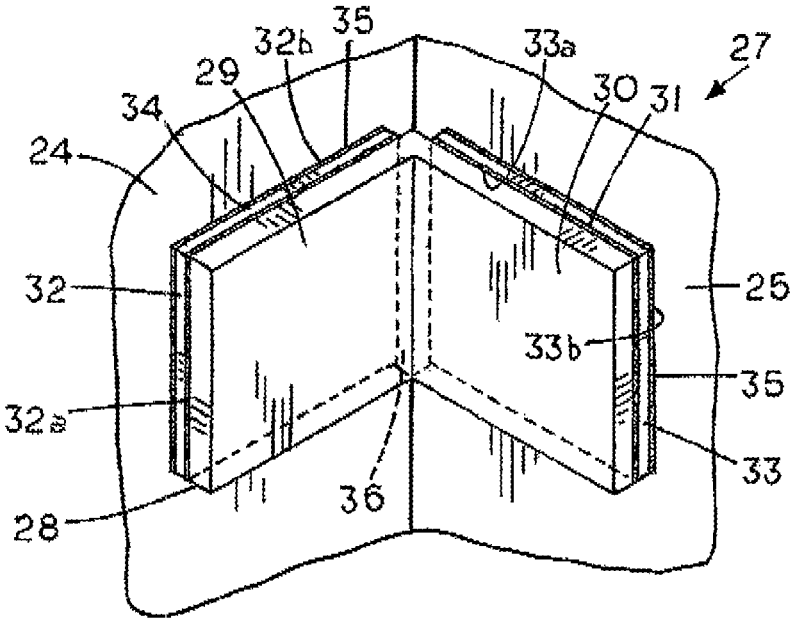
FIG. 4 is perspective view showing an alternative embodiment of a two-sided caulking alignment device positioned at a corner of a room.
Figure 5:
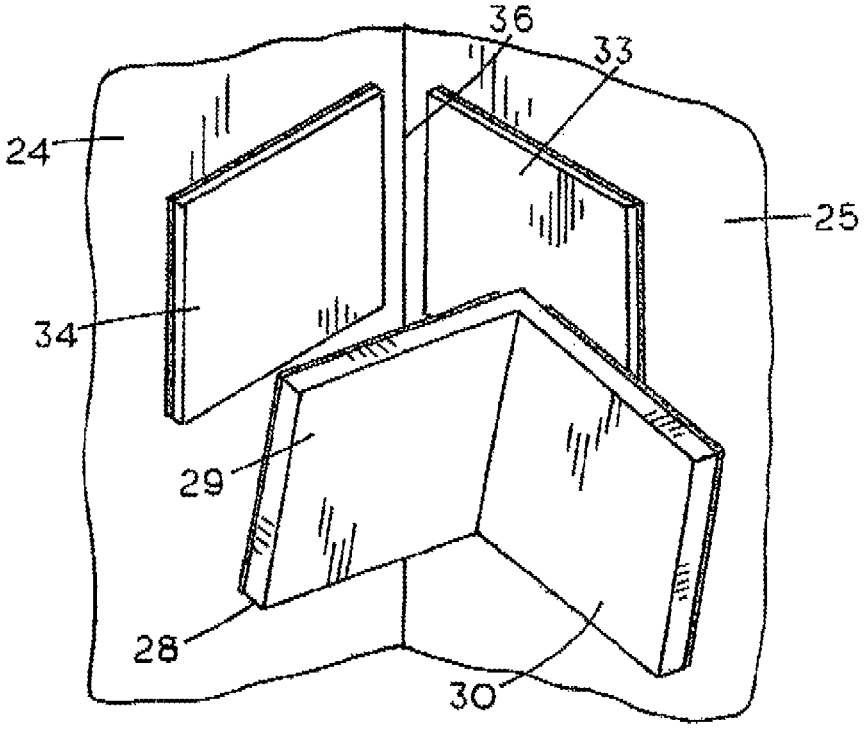
FIG. 5 is a perspective view showing the caulking alignment device of FIG. 4 removably secured to the adjacent surfaces of the room corner.

FIGS. 4 and 5, FIG. 4 is a perspective view showing an alternative embodiment of a two-sided caulking alignment device 27 of the present invention positioned at a corner of a room. FIG. 5 is a perspective view showing the caulking alignment device 27 of FIG. 4 removably secured to the adjacent surfaces of a room corner 24 and 25 to be caulked.

Caulking alignment device 27 includes similar general components to the caulking alignment device 10 of FIG. 1. However, instead of having the semi-rigid base substrate 11 with three panels 12, 13, and 14, caulking alignment device 27 is shown as a one-piece L-shaped semi-rigid base substrate 28 having a first panel 29 and a second panel 30 each having a first non-permanent adhesive 31 located thereon Removably attached to the first panel 29 of base substrate 28 is a first alignment tab 32 having a masking tape engaging front side 32*a* and a first room surface engaging back 32*b* with the masking tape engaging front side 32*a* of the first alignment tab 32 attached to the first panel 29 by the first non-permanent adhesive 31.

Removably attached to the second panel 30 of base substrate 28 is a second alignment tab 33 having a masking tape engaging front side 33*a* and a second room surface engaging back side 33*b* with the masking tape engaging front side 33*a* of the second alignment tab 33 attached to the second panel 30 by the first non-permanent adhesive 31.

As shown in FIG. 4, the second alignment tab 33 is supported on the base substrate 28 in a spaced condition from the first alignment tab 32 with the second room surface engaging back side 32*b* and in turn the second alignment tab 33 located in a perpendicular condition to the first room surface engaging back side 32*b* and in turn the first alignment tab 32.

Located on each of the room surface engaging back side 32*b*, 33*b* of each of the alignment tabs 32, 33 is a second non-permanent adhesive 34 and a removable plastic or paper covering or film covering 35 which functions to protect the second non-permanent adhesive 34 on each of the room surface engaging back sides 32*b*, 33*b* from drying out and/or exposed to contaminants that may reduce the functional properties of the second non-permanent adhesive 34.

FIG. 5 shows the use of the one-piece L-shaped semi-rigid base substrate 28, functioning as a carrier and applicator of the tabs 32 and 33 of the caulking alignment device 27. Once the alignment tabs 32 and 33 are removably attached to the first sidewall 24 and the second sidewall 25, a caulk receiving channel 36 is formed from a spacing between the first alignment tab 32 and the second alignment tab 33 and their engagement with the first sidewall 24 and the second sidewall 25.

Figure 6:
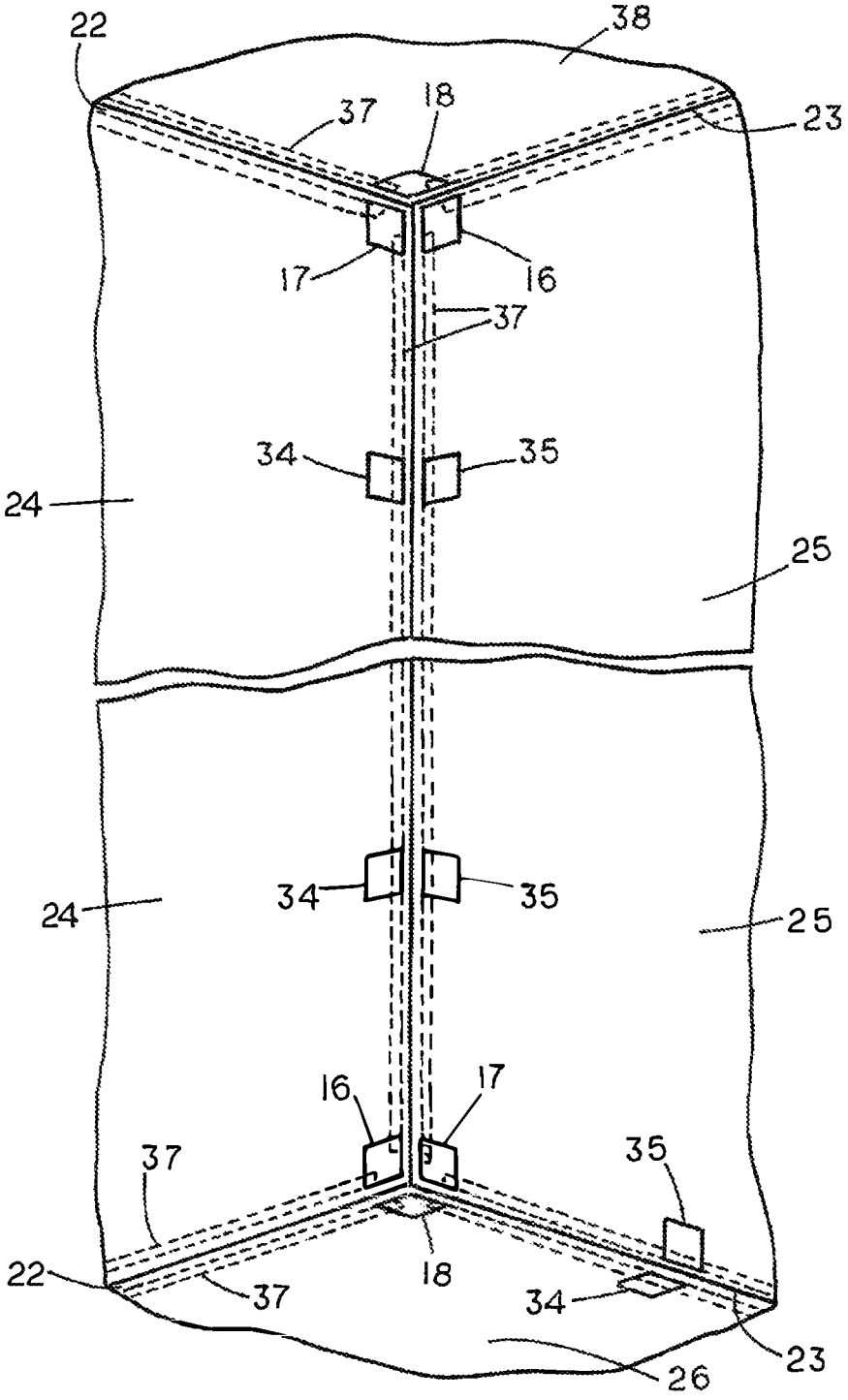
FIG. 6 is a perspective view showing the caulking alignment devices of FIGS. 1 and 4 in use in conjunction with masking tape.

FIG. 6 is a perspective view showing the three-sided caulking alignment device 10 of FIG. 1 and the two-sided caulking alignment device 27 of FIG. 4 being used in conjunction with masking or painter's tape 37 to assist users to perform a quick and visually appealing caulking job.

In use, a first set of alignment tabs 16, 17, and 18 of the three-sided caulking alignment device 10 are removably attached to a lower corner of the room in a spaced and perpendicular condition with respect to each other by way of the first sidewall 24, the second sidewall, and the support surface 26 and a second set of alignment tabs 16, 17, and 18 of the three-sided caulking alignment device 10 are removably attached to a top corner of the room in a spaced and perpendicular condition with respect to each other by way of the first sidewall 24, the second sidewall, and a ceiling surface 38.

A first set of alignment tabs 34 and 35 of the two-sided caulking alignment device 27 and a second set of alignment tabs 34 and 35 of the two-sided caulking alignment device 27 are removably attached to the corner of the room formed by the first sidewall 24 and second sidewall 25 with the first set of alignment tabs 34 and 35 and second set of alignment tabs 34 and 35 located in a spaced condition from each other between the lower corner and the top corner of the room.

The user then uses a stripe of masking or painter's tape 37 to extend the caulk receiving channel from the top corner to the lower corner of the room by connecting the various alignment tabs 16, 17, 34 located on first sidewall 24 with each other and the and connecting the various alignment tabs 16, 17, 34 located on second sidewall 25 with each other through masking or painter's tape 37. The aforementioned steps may also be repeated to prepare the corner between the ceiling surface 38 and the sidewalls 24, 25 of the room and the support surface 26 and the sidewalls 24, 25 of the room for caulking if so desired.

Although FIG. 6 shows the use of both the three-sided caulking alignment device 10 and the two-sided caulking alignment device 27, it is noted that for certain jobs, the use of just the three-sided caulking alignment device 10 or the two-sided caulking alignment device 27 alone is suitable.

Figure 7:
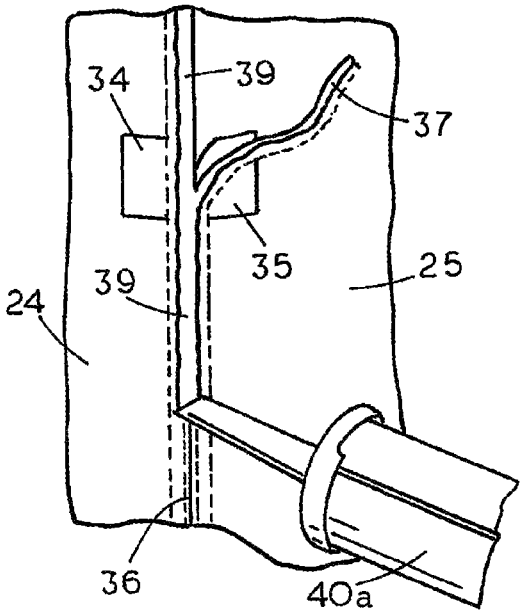
FIG. 7 is a perspective view showing the application of a strip of caulk to a caulk receiving channel through the use of a caulk gun.

Referring to FIG. 7, once a strip of caulk 39 has been applied to the caulk receiving channel 36, such as through the use of a caulk gun 40*a*, each of the stripes of masking or painter's tape 37 may then be peeled away from the room surfaces after which the alignment tabs may then be removed, resulting in a straight visually appealing caulking job.

Figure 8:
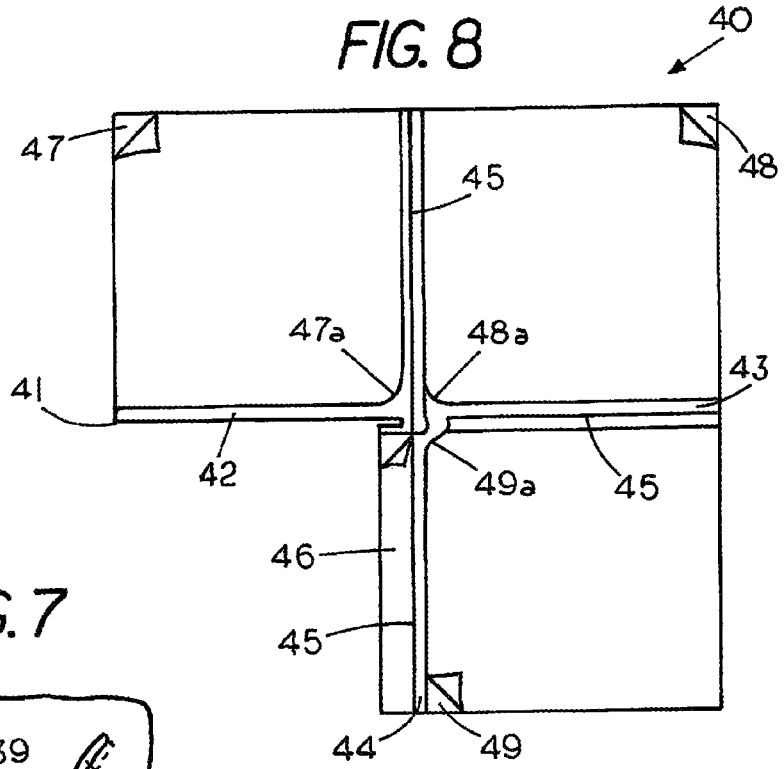
FIG. 8 is a top view showing a three-sided caulking alignment device convertible from a flat storage condition to an upright in-use condition.
Figure 9:
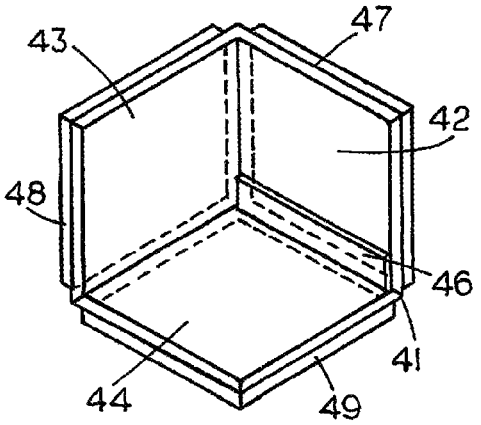
FIG. 9 is a perspective view showing the caulking alignment device of FIG. 8 with the one-piece base substrate in the upright in-use condition.

Referring to FIGS. 8 and 9, FIG. 8 is a top view showing an alternative embodiment of a three-sided caulking alignment device 40 of the present invention having a one-piece base substrate 41 convertible from a flat storage condition to an upright in-use condition with FIG. 8 showing the one-piece base substrate 41 in the flat storage condition. FIG. 9 is a perspective view showing the caulking alignment device 40 of FIG. 8 with the one-piece base substrate 41 in the upright in-use condition.

Caulking alignment device 40 includes similar general components to the caulking alignment device 10 of FIG. 1 and has the same visual appearance as the caulking alignment device 10 when in the upright in-use condition. However, when in the flat storage condition, the one-piece base substrate 41 has a generally linear L-shaped body comprising a first panel 42 connected to a second panel 43 and the second panel 43 connected to a third panel 44.

To assist in guiding the user in the conversion of the base substrate from the flat storage condition to the in-use condition the one-piece base substrate 41 preferably includes a folding crease 45 such as but not limited to a partial linear cut of the base substrate 41 and score lines to allow users to easily bend the one-piece base substrate 41 such that each of the panels 42, 43, 44 are positioned in a generally perpendicular position with respect to each other.

To maintain the base substrate 41 in the in-use condition caulking alignment device 40 is shown including a foldable flap 46 extending from a side of the third panel 44 proximal the first panel 42. As shown in FIG. 9, foldable flap 46 preferably includes an adhesive located thereon for securement with a portion of the first panel 42. The aforementioned allows for a second alignment tab 48 to be supported in a perpendicular condition to the first alignment tab 47 and a third alignment tab 49 located in a perpendicular condition to the first alignment tab 47 and to the second alignment tab 48.

Another feature shown in the embodiment of FIG. 8 is that the corners of each of the alignment tabs 47, 48, 49 located proximal an intersection of the folding creases 45 may include a curve-shaped corners 47*a*, 48*a*, 49*a* to provide aesthetically pleasing caulk beading due to caulk build-up after the alignment tabs 47, 48, 49 are removed from the room surfaces.

Although not shown, an alternative embodiment of the present invention may comprise a caulking alignment device that is directed for use around objects or structures having a radius. The aforementioned caulk alignment device may include a handle portion to allow user ease in the securement of the caulking alignment device around a circular object to be caulked and a one-piece semi-flexible to flexible but form maintaining base substrate with the handle portion extending from the base substrate.

The base substrate includes at least one panel supporting as few as one to a plurality of alignment tabs thereon with the panel including a radius surface engaging first end and a second end. In one embodiment of the present invention the alignment tabs each include a masking tape engaging front side and a room surface engaging back side with the masking tape engaging front side of the alignment tab removably attached to the panel by an adhesive. The panel may include a plurality of slits located along the second end of the panel facilitate the securement of the caulking alignment device around a circular object to be caulked.

In an alternative embodiment of the present invention the alignment tab(s) may include front sides without the need for use of masking tape and a room surface engaging back side.

Located on the room surface engaging back side of each of the alignment tabs is a non-permanent adhesive for supporting a removable film covering thereto, the removable film covering functioning to protect the non-permanent adhesive on each of the room surface engaging back sides from dirt and contaminants that may reduce the effectiveness and/or use-life of the non-permanent adhesive.

A feature of the above invention is that the alignment tab(s) is supported on the panel in a condition in which the curved first end of the alignment tab(s) is spaced from the radius surface engaging end of the panel(s) by a distance "d" to form a caulk receiving channel located between the curved structure to be caulked and the alignment tab(s) when the alignment tab(s) are temporarily secured to the surface of a room.

I claim:

1. A caulking alignment device comprising:

a one-piece semi-rigid base substrate having a first panel, a second panel, and a third panel;

a first non-permanent adhesive located on each of said panels of said base substrate;

a first alignment tab having a masking tape engaging front side and a first room surface engaging back side, said masking tape engaging front side of said first alignment tab removably attached to said first panel by said first non-permanent adhesive;

a second alignment tab having a masking tape engaging front side and a second room surface engaging back side, said masking tape engaging front side of said second alignment tab removably attached to said second panel by said first non-permanent adhesive, said second alignment tab supported on said base substrate in a spaced condition from the first alignment tab with said second room surface engaging back side located perpendicular to said first room surface engaging back side;

a third alignment tab having a masking tape engaging front side and a third room surface engaging back side, said masking tape engaging front side of said third alignment tab removably attached to said third panel by said first non-permanent adhesive, said third alignment tab supported on said base substrate in a spaced condition from the first alignment tab and said second alignment tab with said third room surface engaging back side located perpendicular to said first room surface engaging back side and said second room surface engaging back side;

a second non-permanent adhesive located on each of said room surface engaging back sides;

a removable film covering and protecting the second non-permanent adhesive on each of said room surface engaging back sides; and a first caulk receiving channel formed from a spacing between the first alignment tab and the second alignment tab, a second caulk receiving channel formed from a spacing between the first alignment tab and the third alignment tab and a third caulk receiving channel formed from a spacing between the second alignment tab and the third alignment tab when said alignment tabs are each temporarily securable to a surface of a room.

2. The caulking alignment device of claim 1 wherein a corner of each of said alignment tabs located proximal an intersection of said first, second and third caulk receiving channels comprise a curve-shaped corner to provide aesthetically pleasing caulk beading due to caulk build-up after said alignment tabs are removed from said room surfaces.

3. The caulking alignment device of claim 2 wherein said base substrate comprises a transparent material to allow users to confirm proper securement and alignment of said alignment tab to said surfaces of said room.

4. The caulking alignment device of claim 3 wherein said base substrate, said alignment tabs, and removable film are made from a recyclable material and compostable material.

5. A caulking alignment device comprising:

a one-piece semi-rigid base substrate having a first panel and a second panel;

a first adhesive located on each of said panels of said base substrate;

a first alignment tab having a masking tape engaging front side and a first room surface engaging back side, said masking tape engaging front side of said first alignment tab removably attached to said first panel by said first adhesive;

a second alignment tab having a masking tape engaging front side and a second room surface engaging back side, said masking tape engaging front side of said second alignment tab removably attached to said second panel by said first adhesive, said second alignment tab supported on said base substrate in a spaced condition from the first alignment tab with said second room surface engaging back side located perpendicular to said first room surface engaging back side;

a second non-permanent adhesive located on each of said room surface engaging back sides;

a removable film covering and protecting the second non-permanent adhesive on each of said room surface engaging back sides; and a caulk receiving channel formed from a spacing between the first alignment tab and the second alignment tab when said first alignment tab and said second alignment tab are temporarily securable to a surface of a room.

6. The caulking alignment device of claim 5 wherein said one-piece semi-rigid base substrate comprises an L-shaped semi-rigid base substrate.

7. The caulking alignment device of claim 5 wherein said base substrate, said alignment tabs, and removable film are made from a recyclable material and compostable material.

8. The caulking alignment device of claim 5 wherein said base substrate comprises a transparent material to allow users to confirm proper securement and alignment of said alignment tab to said surfaces of said room.

9. The caulking alignment device of claim 5 wherein said one-piece semi-rigid base substrate comprises a one-piece semi-rigid base substrate having the first panel, the second panel, and a third panel and including:

a third alignment tab having a masking tape engaging front side and a third room surface engaging back side, said masking tape engaging front side of said third alignment tab removably attached to said third panel by said first non-permanent adhesive, said third alignment tab supported on said base substrate in a spaced condition from the first alignment tab and said second alignment tab with said third room surface engaging back side located perpendicular to said first room surface engaging back side and said second room surface engaging back side; and a second caulk receiving channel formed from a spacing between the first alignment tab and the third alignment tab and a third caulk receiving channel formed from a spacing between the second alignment tab and the third alignment tab when said alignment tabs are each temporarily securable to a surface of a room.

10. The caulking alignment device of claim 9 wherein a corner of each of said alignment tabs located proximal an intersection of said first, second and third caulk receiving channels comprise a curve-shaped corner to provide aesthetically pleasing caulk beading due to caulk build-up after said alignment tabs are removed from said room surfaces.

11. A caulking alignment device comprising:

a one-piece base substrate convertible from a flat storage condition to an in-use condition, said base substrate having a first panel and a second panel;

a first non-permanent adhesive located on each of said panels of said base substrate;

a first alignment tab having a masking tape engaging front side and a first room surface engaging back side, said masking tape engaging front side of said first alignment tab removably supported on said first panel by said first non-permanent adhesive;

a second alignment tab having a masking tape engaging front side and a second room surface engaging back side, said masking tape engaging front side of said second alignment tab removably supported on said second panel by said first non-permanent adhesive, said second alignment tab supported on said base substrate in a spaced condition from the first alignment tab, said second room surface engaging back side located perpendicular to said first room surface engaging back side when said base substrate is in said in-use condition;

a second non-permanent adhesive located on each of said room surface engaging back sides;

a removable film covering and protecting the second non-permanent adhesive on each of said room surface engaging back sides; and a caulk receiving channel formed from a spacing between the first alignment tab and the second alignment tab when said base substrate is in said in-use condition and said first alignment tab and said second alignment tab are each temporarily securable to adjacent surfaces of a room.

12. The caulking alignment device of claim 11 wherein said one-piece base substrate comprises a one-piece semi-rigid base substrate.

13. The caulking alignment device of claim 12 including a folding crease located between said panels of said base substrate to guide said user in the conversion of said base substrate from said flat storage condition to said in-use condition.

14. The caulking alignment device of claim 13 wherein said folding crease located between said panels of said base substrate comprises a partial linear cut of said base substrate to guide said user in the conversion of said base substrate from said flat storage condition to said in-use condition.

15. The caulking alignment device of claim 14 wherein said one-piece semi-rigid base substrate comprises a one-piece semi-rigid base substrate having the first panel, the second panel, and a third panel and including:

a third alignment tab having a masking tape engaging front side and a third room surface engaging back side, said masking tape engaging front side of said third alignment tab removably attached to said third panel by said first non-permanent adhesive, said third alignment tab supported on said base substrate in a spaced condition from the first alignment tab and said second alignment tab with said third room surface engaging back side located perpendicular to said first room surface engaging back side and said second room surface engaging back side when said base substrate is in said in-use condition; and a second caulk receiving channel formed from a spacing between the first alignment tab and the third alignment tab and a third caulk receiving channel formed from a spacing between the second alignment tab and the third alignment tab when said base substrate is in said in-use condition and said first, second, and third alignment tab are each temporarily securable to adjacent surfaces of a room.

16. The caulking alignment device of claim 15 including a foldable flap attaching said third panel to said first panel in said in-use condition to maintain said base substrate in said in-use condition.

17. The caulking alignment device of claim 16 wherein a corner of each of said alignment tabs located proximal an intersection of said first, second and third caulk receiving channels comprise a curve-shaped corner to provide aesthetically pleasing caulk beading due to caulk build-up after said alignment tabs are removed from said room surfaces.

18. The caulking alignment device of claim 17 wherein said base substrate, said alignment tabs, and removable film are made from a recyclable material and compostable material.

19. The caulking alignment device of claim 18 wherein said base substrate comprises a transparent material to allow users to confirm proper securement and alignment of said alignment tab to said surfaces of said room.

* * * * *